US006077180A

United States Patent [19]

Adams, Jr.

[11] Patent Number: 6,077,180

[45] Date of Patent: Jun. 20, 2000

[54] ARCHERY BROADHEAD

[76] Inventor: Charles C. Adams, Jr., P.O. Box 30480, Jackson, Wyo. 83001

[21] Appl. No.: 09/232,583

[22] Filed: Jan. 16, 1999

[51] Int. Cl.[7] ..... F42B 6/08

[52] U.S. Cl. ..... 473/584

[58] Field of Search ..... 473/578, 582, 473/583, 584, FOR 216, FOR 219, FOR 221, FOR 222

[56] References Cited

U.S. PATENT DOCUMENTS

| | | | |
|---|---|---|---|
| 2,940,758 | 6/1960 | Richter | 473/584 |
| 4,210,330 | 7/1980 | Kosbab | 473/584 |
| 4,529,208 | 7/1985 | Simo | 473/584 |
| 4,676,512 | 6/1987 | Simo | 473/584 |
| 4,901,467 | 2/1990 | Stolpe | 473/582 X |
| 5,160,148 | 11/1992 | Musacchia | 473/584 |
| 5,417,440 | 5/1995 | Barrie et al. | 473/584 |
| 5,482,294 | 1/1996 | Sullivan et al. | 473/584 |
| 5,494,298 | 2/1996 | Maleski | 473/584 |
| 5,820,498 | 10/1998 | Maleski | 473/584 |

*Primary Examiner*—John A. Ricci
*Attorney, Agent, or Firm*—Mallinckrodt & Mallinckrodt

[57] ABSTRACT

An archery broadhead has twelve broadhead blade receiving slots to receive a plurality of broadhead blades in selected slots. A variety of different orientations of two blades, three blades, four blades, or more can be used to assemble a desired broadhead. By providing blades of different weights and a selection of different weight points and collars, the archer is given the opportunity to create a broadhead of blade configuration and weight as desired. A spearhead point with only two cutting blades and convex faces between the blades provides improved cutting and penetration of a target.

11 Claims, 4 Drawing Sheets

ARCHERY BROADHEAD

BACKGROUND OF THE INVENTION

1. Field

The invention is in the field of broadhead arrow-heads used as part of archery arrows.

2. State of the Art

There are currently a wide variety of broadhead hunting arrowheads commercially available for use in building an archery arrow by attaching the broadhead to the forward end of an arrow shaft in usual manner by screwing the broadhead into the normal internally threaded insert in the forward end of the arrow shaft. Generally, a particular broadhead will have either two, three, or four blades and will have fixed positions for these blades about the circumference of the broadhead. This provides limited adjustment for the archer to align the blades with the fletching on the arrow or to make other adjustments desired by the archer. Further, the archer cannot vary the weight or number of blades on the particular broadhead.

SUMMARY OF THE INVENTION

According to the invention, a broadhead includes a ferrule having twelve blade receiving grooves along its length to selectively receive blades therein. The grooves are evenly spaced circumferentially around the ferrule. By using twelve blade receiving grooves, an archer can selectively use two, three, or four blade configurations for the broadhead (can use more blades if desired) and can place such blades in a variety of locations so as to align the blades with the arrow fletching configuration, align the blades with the cutting edges of the tip or point, or to place the blades in other desired orientations.

The broadhead of the invention preferably includes a removable point to allow blade loading from either the front or the rear. With this feature, once the broadhead ferrule is attached and aligned with the arrow shaft, it can remain so attached and does not have to be removed for blade replacement or adjustment since such blade replacement and adjustment can be done from the front.

In addition, blades to fit the broadhead can be made available in different weights so blades can be replaced to adjust the weight of the broadhead. Different weight blades can conveniently be made by varying the amount of material cut out from the blades.

The invention also includes a unique spearhead point or tip which penetrates deeper and resists damage to a greater extent than currently available points. The point has a rounded forward edge which forms two cutting edges with two broad faced sides extending rearwardly therefrom, preferably in a convex configuration. The point may be made in different weights to allow the archer to further adjust the total weight of the broadhead.

THE DRAWINGS

The best mode presently contemplated for carrying out the invention is illustrated in the accompanying drawings, in which:

FIG. 1 is a perspective view of a three blade version of the broadhead of the invention;

FIG. 2, a side elevation of a four blade version of the broadhead mounted in an arrow shaft, the arrow shaft and arrow shaft insert being shown in section;

FIG. 3, a longitudinal vertical section taken on the line 3—3 of FIG. 2;

FIG. 4, a front elevation of the broadhead of FIG. 2, taken on the line 4—4 of FIG. 2;

FIG. 5, a vertical section of the broadhead of FIG. 2 taken on the line 5—5 of FIG. 2;

FIG. 6, a vertical section similar to that of FIG. 5, but showing a three blade version of the broadhead rather than the four blade version of FIG. 5;

FIG. 7, a vertical section similar to that of FIGS. 5 and 6, but showing a two blade version of the broadhead; and FIG. 8, an assembly drawing of the broadhead showing how blades, point, and collar can be interchanged.

DETAILED DESCRIPTION OF THE ILLUSTRATED EMBODIMENT

Figure 2:
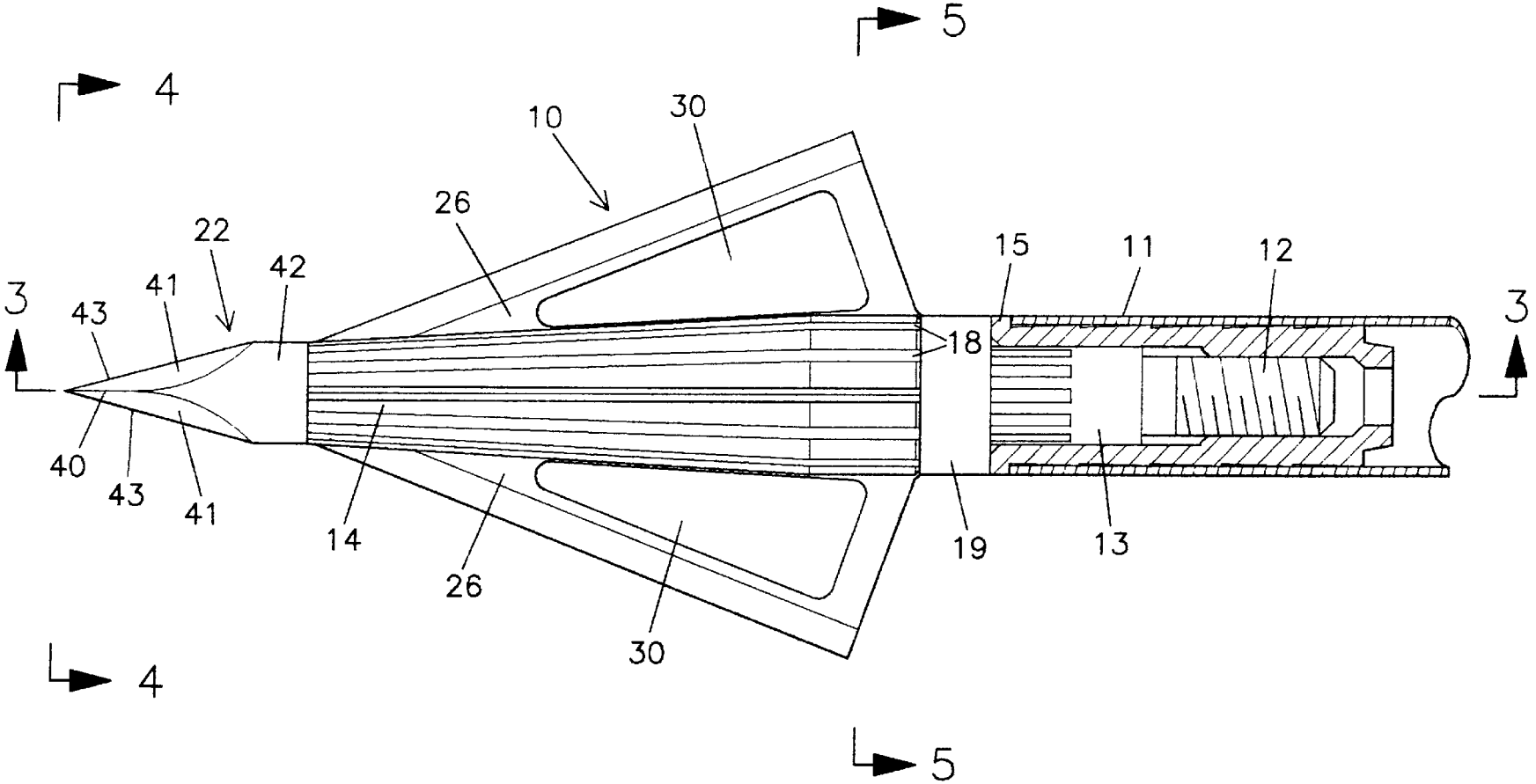

FIG. 2 shows the broadhead 10 of the invention secured in normal manner to the forward end of an arrow shaft 11. Broadhead 10 has a standard threaded stud 12 extending from alignment shoulder 13 at the rearward end of broadhead ferrule 14 to be screwed into arrow shaft insert 15 secured to the forward end of arrow shaft 11 in normal manner. Both stud 12 and aligned shoulder 13 fit into insert 15 in normal manner as with any broadhead.

Figure 3:
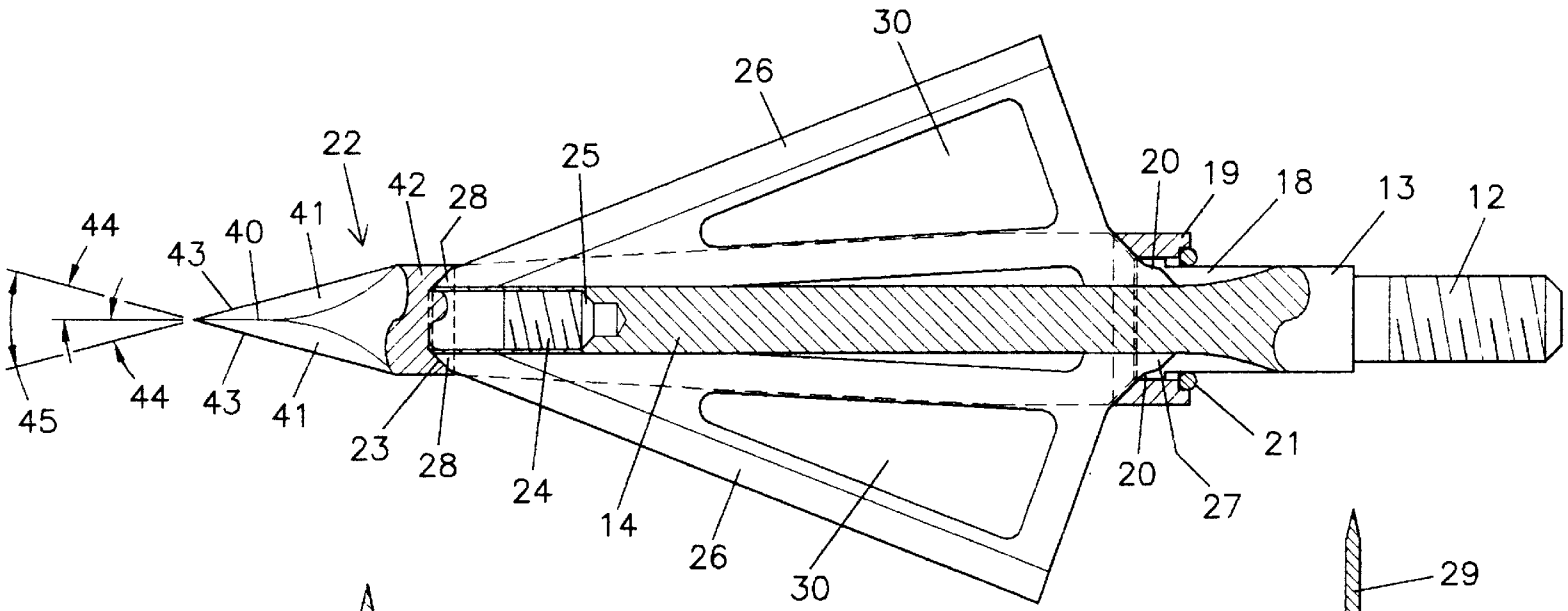
Figure 8:
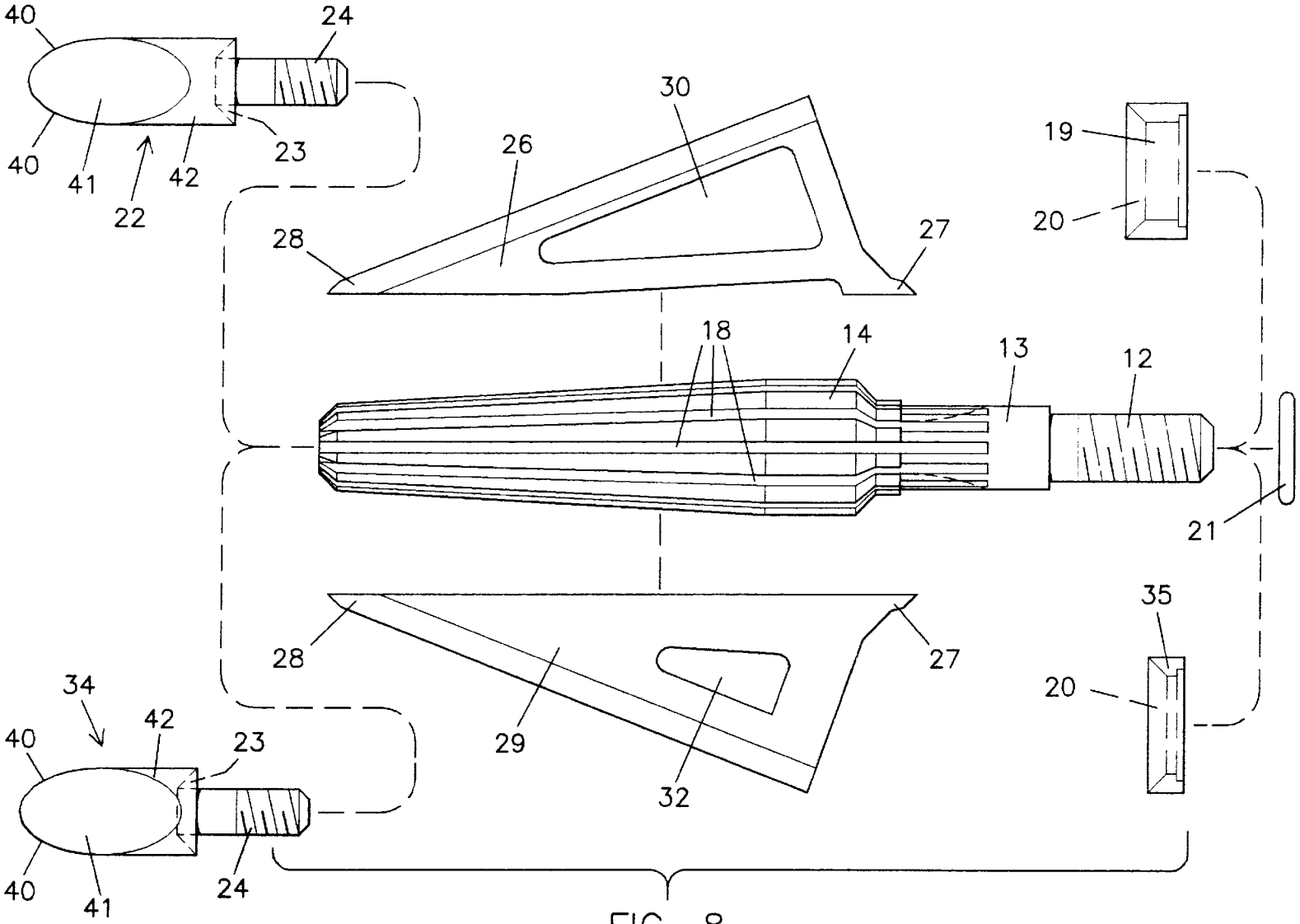

Ferrule 14 includes twelve blade receiving slots 18 extending the length of the ferrule from front to rear of the ferrule. The slots are equally spaced circumferentially around the ferrule. A rear assembly collar 19 forming rear tapered blade capture ring 20, FIGS. 3 and 8, is positioned at the forward end of alignment shoulder 13 and when the broadhead is attached to an arrow shaft, is sandwiched between the rearward end of ferrule 14 and the forward end of arrow shaft insert 15, FIG. 2. An O-ring 21 is positioned over alignment shoulder 13 behind rear assembly collar 19 to hold it in position on shoulder 13 when not inserted into an arrow, and to more securely hold the broadhead to the arrow when installed in an arrow shaft.

A point or tip 22 forming a forward tapered blade capture ring 23, FIGS. 3 and 8, is secured forwardly of the ferrule 14 by means of threaded stud 24 screwed into receiving threaded bore 25 in ferrule 14.

A plurality of blades 26 (shown as four blades in FIGS. 2, 3, 4, and 5) are secured in circumferentially spaced selected blade receiving slots 18 with rear holding tabs 27, FIGS. 3 and 8, received in rear tapered blade capture ring 20 and forward holding tabs 28 in forward tapered blade capture ring 23. The blades 26 can be assembled into blade receiving slots 18 in ferrule 14 by either loosening or removing, by unscrewing, ferrule 14 from arrow shaft insert 15 and sliding rear assembly collar 19 rearwardly to the extent necessary to pass rear holding tabs 27 ahead of collar 19 into rear tapered blade capturing ring 20 or by loosening or removing tip 22, by unscrewing, to the extent necessary to pass forward holding tabs 28 behind point 22 into forward tapered blade capture ring 23. By making tip 22 removable, blade replacement may take place by loosening or removal of tip 22 without needing to loosen or remove ferrule 14 from the arrow shaft. Thus, once installed on an arrow shaft, ferrule 14 can remain securely in position at the forward end of the arrow shaft with only tip 22 being loosened or removed to change blades.

Figure 1:
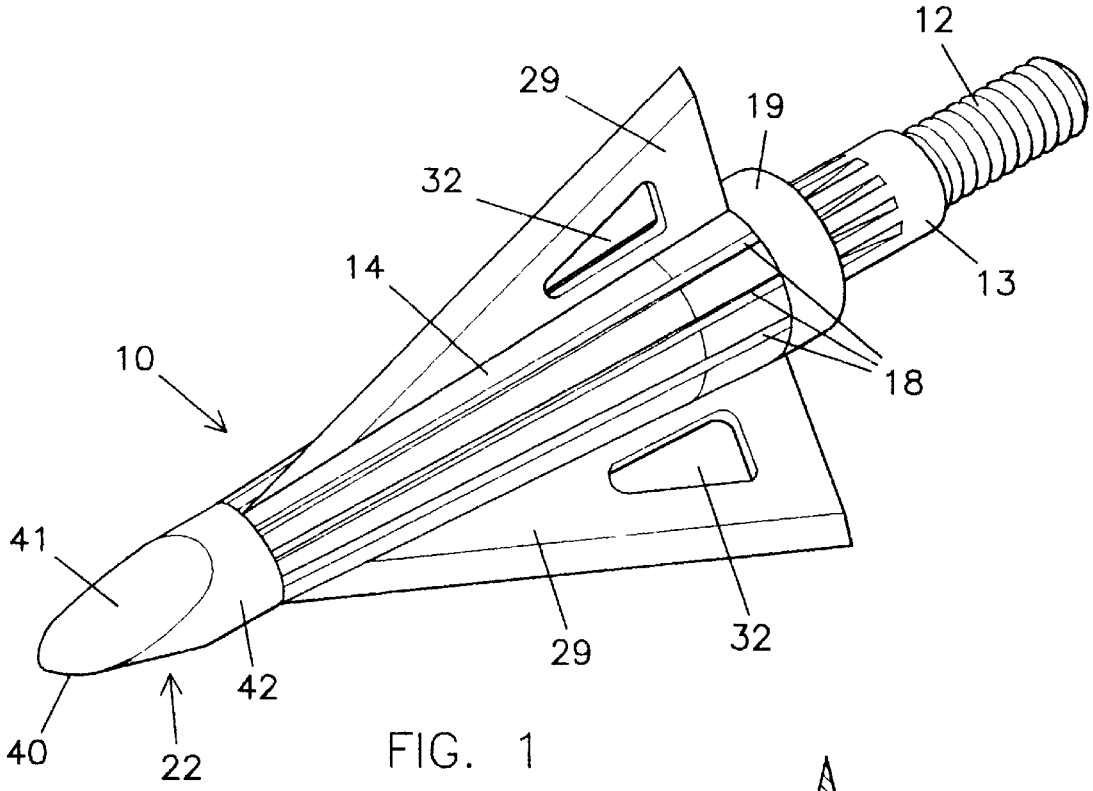
Figure 5:
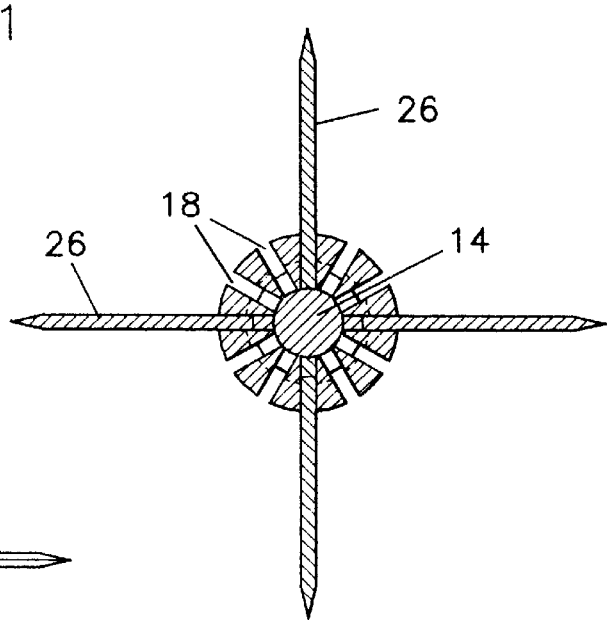
Figure 4:
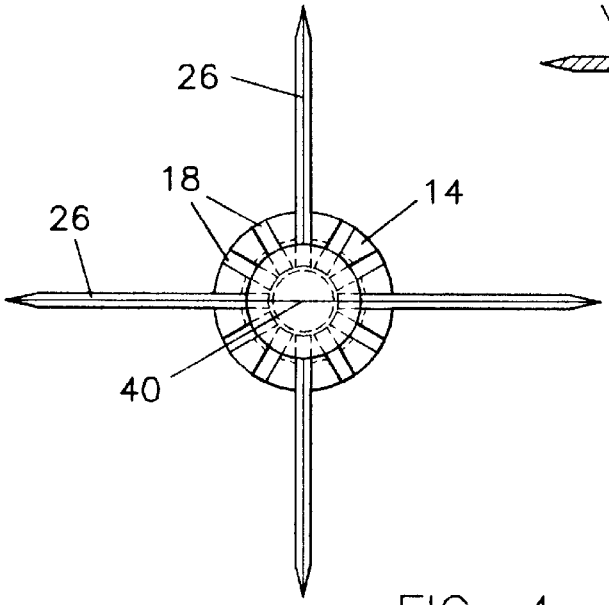
Figure 7:
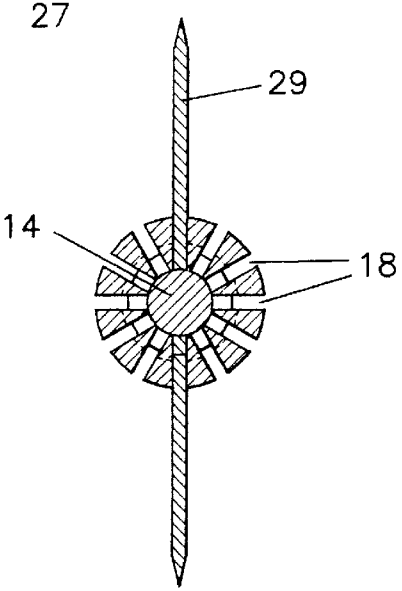
Figure 6:
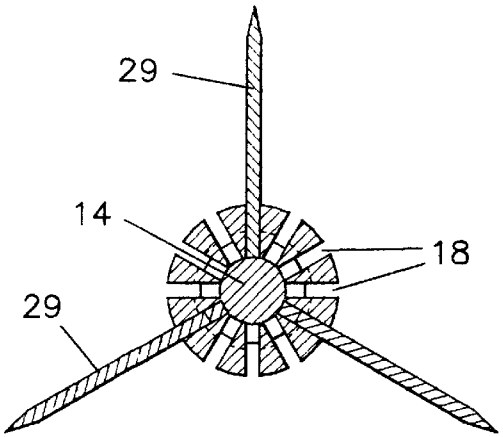

With twelve blade receiving slots 18 in ferrule 14, four equally spaced blades 26, FIGS. 2–5, (90° spacing) may be inserted in one of three orientations in the broadhead. Non-equally spaced blades (e.g. 60° spacing between two opposite sets of blades and 120° space between the other two opposite sets of blades) may also be inserted in one of three different orientations. If a three blade arrangement is desired, FIGS. 1 and 6, three equally spaced blades 29 (120° spacing) may be inserted into one of four orientations in the broadhead. This allows the blades to be easily aligned with arrow fletching (three or four vane fletching) if desired or easily aligned in other orientations as desired by the archer. If a two blade arrangement is desired, FIG. 7, the two blades may be selectively placed in one of six different orientations of opposite slots. While generally more than four blades will not be used because of weight and drag when the broadhead hits a target, if desired more than four blades can be used. For example, six equally spaced blades can be selectively placed in one of two orientations in ferrule 14, or arrangements of eight or twelve blades, or other desired number of blades, may be used.

As can be appreciated, with twelve blade receiving slots in the ferrule, broadheads with the common two, three, and four blade arrangements can easily be assembled as desired by the archer with selectable orientations for each arrangement. This provides the archer with flexibility not provided by any other broadhead.

Broadhead blades, such as 26 shown in FIGS. 2–5 and 8, generally include cut-out portions 30 to reduce the weight of the blades to a desired value. Applicant has found that by providing different size cut-outs for the same blade shape and construction, blades of different weights can be provided to fit the same broadhead. Thus, for example, blades 26 with cut-out 30 may be constructed to weigh 10 grains each. Blades 29, FIGS. 1 and 6, with smaller cut-outs 32, FIG. 1, may weigh 15 grains. The shape and outer dimensions of the blades 26 and 29 are the same so that either blade may be inserted into and secured in ferrule 14. By using different weight blades, an archer can adjust the weight of the broadhead. If different weight points are available, such as twenty-five and twenty grain points, 22 and 34, FIG. 8, and different weight rear assembly collars are available such as ten and five grain collars, 19 and 35, by changing points, blades, and collars, a wide range of broadhead weight can be selected. With a ferrule assembly (ferrule, alignment shoulder, and stud) weighing forty-five grains and using the ten grain blades, broadhead weights of between ninety grains (two blade arrangement) and one hundred twenty grains (four blade arrangement) in five grain increments can be assembled. Keeping only a three blade arrangement, broadheads with weights between one hundred and one hundred and ten grains can be assembled. Using the fifteen grain blades, broadhead weights of between one hundred grains (two blade arrangement) and one hundred and forty grains (four blade arrangement) in five grain increments can be assembled. Again, keeping only a three blade arrangement, broadheads with weights between one hundred and fifteen and one hundred and twenty-five grains can be assembled. It should be noted that blades of different weights can be used together, such as in a four blade arrangement, two of the blades may be of one weight and two may be of another weight.

Flexibility in changing the weight of the broadhead is an advantage to the archer in that it allows the archer to fine tune his arrows, add or subtract weight to alter arrow trajectory and energy level, and to change the front-of-center balance of the arrow.

In addition to the flexibility that the twelve slot ferrule provides the archer in terms of adjustment with two, three, four, or more blade arrangements and adjustments of weight, the slots not filled with a blade appear to channel air along the ferrule for superior broadhead flight and stability. Also the unused slots improve penetration of the broadhead, maybe because there is less ferrule friction against the skin and flesh and there is no smooth surface to suction the skin and flesh.

While any conventional shape point can be used with the twelve slot ferrule, it has been found that a spearhead point configuration provides better bone splitting ability and deeper penetration. Also, such point appears to better resist damage upon impact. This is true when the spearhead point configuration is used in connection with any broadhead.

The spearhead point has only two cutting edges extending from the forwardmost point on the cutting edge rather than the three or four cutting edges used for most broadhead points or merely the conical point used on some broadheads. While two straight cutting edges can be used coming to a point formed by the intersection of the two straight edges, it is currently preferred to use a spear-head point having rounded forward cutting edges 40, rather than straight edges, with two opposed broad faced sides 41 extending rearwardly therefrom. The broad faced sides 41 are somewhat rounded in convex manner as they extend from the outer cylindrical rear portion 42 of the point to the cutting edge 40. The middle of each broad face 41 forms a substantially straight line 43, FIGS. 2 and 3, from the forwardmost point on the rounded forward edge to cylindrical rear portion 42. Each of these lines preferably extends at an angle 44, FIG. 3, of about 15° to the longitudinal axis of the broadhead and arrow shaft to which it is attached, making the angle 45 between the two lines about 30°. A radius for the rounded forward or leading edge 40 of about 0.156 inch has been found to work well with a cylindrical portion diameter of 0.210 inch. With such dimensions, line 43 will be about 0.406 inches long.

Rather than convex broad sides between the cutting edges 40, other configurations such as flat sides or concave sides can be used with appropriate sloping and shaping between the sides and the cylindrical rear portion 42.

By providing just two cutting edges for the point, the point initially will slice into the target rather than wedging into the target as with three or four edge points or conical points. This cutting allows deeper penetration of the target.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. An archery broadhead, comprising:

a ferrule having twelve blade receiving slots therealong for receiving broadhead blades in selected slots;

a plurality of less than twelve broadhead blades;

means for securing the plurality of broadhead blades in the selected slots; and means for securing the broadhead to the forward end of an archery arrow.

2. An archery broadhead according to claim 1, wherein the ferrule has a forward end, and additionally including a removable point at the forward end of the ferrule.

3. An archery broadhead according to claim 2, wherein the point is of spearhead configuration with a forwardmost point and only two cutting edges extending rearwardly from the forwardmost point.

4. An archery broadhead according to claim 3, wherein the cutting edges are rounded as they extend rearwardly from the forwardmost point.

5. An archery broadhead according to claim 4, having two opposing broad faces extending between the cutting edges, and wherein such broad faces are of convex configuration.

6. An archery broadhead according to claim 1, wherein the plurality of broadhead blades is two broadhead blades.

7. An archery broadhead according to claim 1, wherein the plurality of broadhead blades is three broadhead blades.

8. An archery broadhead according to claim 1, wherein the plurality of broadhead blades is four broadhead blades.

9. A point for use with an archery broadhead having a forward end, comprising:

a point body of spearhead configuration with a forwardmost point and only two cutting edges extending rearwardly from the forwardmost point; and means for attaching the point body to the forward end of the broadhead.

10. A point for use with an archery broadhead according to claim 9, wherein the cutting edges are rounded as they extend rearwardly from the forwardmost point.

11. A point for use with an archery broadhead according to claim 9, wherein the point has two opposing broad faces extending between the cutting edges, and wherein such broad faces are of convex configuration.

* * * * *